United States Patent [19]

Link et al.

[11] 4,438,730

[45] Mar. 27, 1984

[54] PROCESS FOR THE GENERATION OF STEAM

[75] Inventors: Gerhard Link, Mainz; Siegfried Jung, Florsheim-Wicker; Reinhold Zapp, Waldem; Helmut Bär, Offenbach am Main; Herbert Mader, Nauheim, all of Fed. Rep. of Germany

[73] Assignee: Uhde GmbH, Dortmund, Fed. Rep. of Germany

[21] Appl. No.: 359,152

[22] Filed: Mar. 17, 1982

[30] Foreign Application Priority Data

Mar. 18, 1981 [DE] Fed. Rep. of Germany ..... 3110520

[51] Int. Cl.[3] ..... F22B 27/00

[52] U.S. Cl. ..... 122/40; 60/648; 122/451 S; 122/459; 203/26; 203/DIG. 14; 203/DIG. 20

[58] Field of Search ..... 122/4 R, 40, 451 S, 122/459; 60/648, 649, 641.8; 203/26, DIG. 20, DIG. 14

[56] References Cited

U.S. PATENT DOCUMENTS

| | | | |
|---|---|---|---|
| 3,962,873 | 6/1967 | Davis | 60/641.8 |
| 4,239,603 | 12/1980 | Egosi | 122/40 |
| 4,282,070 | 8/1981 | Egosi | 203/26 |

*Primary Examiner*—Edward G. Favors
*Assistant Examiner*—Steven E. Warner
*Attorney, Agent, or Firm*—Fraser, Barker, Purdue & Clemens

[57] ABSTRACT

The inventive combination provides for a profitable and efficient utilization of low-pressure waste heat in conjunction with medium-pressure steam. The combination of mechanical and thermodynamic compression for the generation of superheated low-pressure steam is a method that has better results regarding energy and cost than any other known configuration.

19 Claims, No Drawings

PROCESS FOR THE GENERATION OF STEAM

BACKGROUND OF THE INVENTION

The invention relates to a process for the generation of steam with a pressure of 3.0 to 6.0 bar and a temperature of 140° to 165° C. by evaporating and compressing heat-transfer liquids at a low temperature.

Whenever the term "bar" is used herein, it is to be understood as "bar absolute". Heat-transfer liquids normally obtain their heat capacity as a result of heat evolution in chemical processes and/or they are hot condensates.

An external heat supply is often required for chemical reaction or separation processes because certain reactions take place only at defined temperatures and/or in the presence of heat. The reaction products normally have to be cooled to ambient temperature and condensed. Whereas heat capacities with a temperature range of over 150° C. are well suited for heat transfer because of the thermodynamic quality, heat capacities at temperatures of approximately 100° C. can hardly be utilized and must therefore be dissipated by means of heat exchangers operated with air or cooling water.

Many chemical process plants have interconnected heating systems and normally they are integrated, i.e. most of their heating systems are coupled. Heat sources, such as product streams and utilities, that require cooling or product vapors that have to be condensed are exploited by transferring heat to boiler feed water in tubular heat exchangers in parallel or in series for steam generation. Part of the steam generated is used for driving turbines and other steam operated equipment and partly for heating the plant equipment. Condensates are thus obtained at different pressures and temperatures. Since the process units cannot constantly run at design load, i.e. part-load or even temporary shutdowns are inevitable, the steam system will have different pressure levels sufficient to supply slightly superheated steam at the specified temperature to distant plant equipment. For this reason, there are normally two levels: a medium-pressure level of approximately 15 to 25 bar and a low-pressure level of 3 to 6 bar. Medium-pressure steam is suited for a heating temperature of approximately 220° C. or can be used as propellent steam for steam-jet ejectors or as driving steam for steam turbines. Low-pressure steam is chiefly suited for heating. It has a pressure of 3 to 6 bar and a temperature slightly above the saturated steam temperature. Thus, it can be safely piped to and used in distant plant equipment. If there is not sufficient low-pressure steam, it is necessary to withdraw steam from the medium-pressure system, to reduce it to the low pressure required and, if necessary, to inject condensate for desuperheating or saturating the steam. This method is uneconomical because precious steam of high thermodynamic quality is being lost.

Hot condensates of different pressures and condensation temperatures are also typical of chemical process plants. Steam condensates are re-evaporated and fed to the feed-water treatment unit. If the condensates have low pressure and temperature, they constitute a waste and are discharged into the sewer system at atmospheric pressure and approximately ambient temperature. This means prior depressurization and cooling with the aid of air and cooling water. The thermal potential thus cannot be recovered.

Processes are known in which the thermal potential of heat-transfer liquids, which is normally water and has a temperature of approximately 100° C. is exploited by vacuum-evaporation, i.e. below 1 bar. The vapors obtained are mixed with propellent steam and constantly withdrawn by means of steam jet ejectors. Thus the vacuum can be maintained in the system. The pressure of the mixture is, for instance increased to 2 bar in the diffusor of the steam-jet ejector. This is an economical method of increasing the temperature of a certain part of the potential by approximately 25° C. with the aid of high-pressure propellent steam.

If vacuum steam is obtained, the increase mentioned before is normally insufficient because the temperature rises only to approximately 110° to 115° C. In this case the steam must be used in the vicinity of the steam-generating equipment since it is almost impossible to pipe this steam to distant equipment and to use it as heating steam. Piping causes considerable pressure and temperature drops leaving only a hot condensate. Moreover, the temperature is too low in this case. If heat-transfer liquids with different pressures are obtained simultaneously, it is imperative to provide for different steam-jet ejectors, each designed for a certain pressure ratio. If the pressure ratio also varies due to intake pressure rise or drop, the steam ejector will exhibit an unstable and uneconomical performance.

Steam-jet ejectors of special design have proved to be uneconomical for boosting the pressure of over 2 bar because the necessary quantity of propellent steam is a multiple of the intake quantity, i.e. an excess of LP heating steam is obtained.

SUMMARY OF THE INVENTION

The aim of the invention is to eliminate the disadvantages concerning the generation of steam with a pressure of 3.0 to 6.0 bar in chemical process plants and simultaneously to improve the energy recovery from vapors of low thermodynamic quality.

It was surprising to find that the aim of the invention can be achieved by implementing the process criteria described in the main claim and the embodiments stated thereafter.

The special advantages of the invention are that the thermal potential of heat-transfer liquids at a temperature below 80° C. can be exploited by simple and very efficient means for the generation of 3.0 to 6.0 bar steam, thereby increasing the temperature by approximately 50° C. The input quantity of drive energy and propellent steam is reduced to a minimum. Furthermore, the combination of mechanical compressor and thermodynamic steam-jet ejector is particularly flexible. If the mechanical compressor is equipped with an intake throttle governor, the discharge pressure will remain constant in the event of varying steam quantities. Thus, the intake pressure of the steam-jet ejectors also remains constant and extra propellent steam is not required because of the stable pressure ratio. Since steam from the last stage of the mechanical compressor is superheated by approximately 25° C., the steam-jet ejectors have favorable service conditions.

Since the mechanical compressor, which normally has several stages, can be equipped with a certain number of intakes, the evaporation can take place in each stage at a different intake pressure, and consequently, at a different temperature. When a multi-stage turbo-compressor is used, it is possible to maintain a uniform pressure and temperature level for steam from different sources by simple means and a minimum of input energy.

DETAILED DESCRIPTION OF PREFERRED EMBODIMENTS OF THE INVENTION

Owing to the uniform pressure level of the entire steam it is possible, according to the invention, to process a certain part of the steam by means of several steam-jet ejectors. Since all the ejectors are fed with the same propellent steam and have the same discharge pressure, this solution also offers operating advantages for the part-load performance in the event of start-up or shutdown of individual ejectors.

A low temperature level is understood to mean a temperature range of 80° to 115° C., preferably 90° to 105° C. The heat-transfer liquids are preferably evaporated at low temperature and pressure, in the case of water at 0.5 bar minimum, preferably 0.7 bar. The preferred pressure increase should be 1.5 to 1.8 fold if steam-jet ejectors are used.

Mechanical compression is understood to mean primarily a compression by means of a multi-stage turbo-compressor. It is also possible to use other known compressor designs such as screw compressors.

Thermodynamic compression is understood to mean the use of steam-jet ejectors.

It order to reduce the steam temperature in a mechanical compressor to the permissible levels, a further embodiment of the invention provides for condensate injection for the purpose of gradually desuperheating the steam taken in by the multi-stage compressor. Thus, the compression energy is immediately converted into steam which can be exploited profitably.

According to a further embodiment of the invention, the heat-transfer liquids are hot condensates, feed water heated by hot vapors or other fluids such as waste gas or smoke and/or a mixture of both. These embodiments provide for a simultaneous use of hot condensates from different condenser pressure stages and/or of indirect heat-transfer fluids such as the overheads from a rectifying column for feed water evaporation.

Normally, the heat-transfer liquid is water and, consequently, the vapor according to the invention is steam. However, the invention is not restricted to steam, although the intake steam and the propellent steam should be produced from the same liquid. The nature of the invention is not modified if other heat-transfer liquids are used. Any other fluid of adequate temperature is suited for indirect feed-water heating.

According to a further embodiment of the invention, the steam compressed by mechanical means is mixed with depressurized steam having an equal or a higher pressure and produced, for instance, from condensates with a higher pressure. According to a known process, an adequate quantity of condensate is then added to the 3.0 to 6.0 bar steam if the steam from the steam-jet ejectors has to be desuperheated.

The following examples illustrate the surprising technical effect and explain the objective of the invention.

EXAMPLE NO. 1

12,500 kg/h saturated steam of 0.86 bar have to be compressed to 3.8 bar by means of steam-jet ejectors. In this case, 85,650 kg/h propellent steam at a pressure of 16 bar and a temperature of 205° C. have to be fed to the steam ejector, the propellent steam/intake steam ratio being 6.85. The total steam quantity thus obtained amounts to 98,150 kg/h.

Since this ratio is unfavorable and too much propellent steam is required, this solution is considered as uneconomical.

EXAMPLE NO. 2

Feed water evaporates at 0.84 bar and 94° C. with the aid of vapors with a temperature of 103° C. from a rectifying column. Additional steam is generated from condensate withdrawn from several 2.9 bar condensate tanks by re-evaporating it to 0.84 bar. The vapor evaporation and the re-evaporation yield a total quantity of 12,500 kg/h saturated steam.

The total steam quantity of 12,500 kg/h is compressed to 2.45 bar in a multi-stage turbo-compressor which is driven by a back pressure turbine discharging steam at 16 bar and 205° C. In order to ensure that compression is approximately isothermal, the steam superheated in the compression stages is desuperheated between the individual stages by condensate injection. Thus, the driving energy is converted into steam. The steam quantity increases by 735 kg/h and totals 13,235 kg/h. Downstream of the last compression stage, the compressed steam has a superheat of 22° C. An additional quantity of 1100 kg/h saturated steam is generated from the condensate withdrawn from an existing 7.4 bar condensate tank by re-evaporating it to 2.55 bar and mixing it with the superheated compressed steam. Thus 14,335 kg/h steam are produced and sent to the ejector unit. The steam is compressed with the aid of 17,720 kg/h propellent steam from a medium-pressure steam system of 16 bar and 205° C.

The steam-jet ejectors supply a total of 32,055 kg/h slightly superheated steam at 3.8 bar and 154° C. In this case it is possible to reduce the temperature slightly by injecting 500 kg/h condensate at 95° C. which is thus converted into steam. According to the invention it is possible to generate a total of 32,555 kg/h heating steam at 3.8 bar and 145° C. i.e. slightly superheated steam. In this example, the temperature rise is 145° C.–94° C.=51° C. The pressure and the superheating temperature are such that the steam generated can be used as heating steam for many purposes.

EXAMPLE NO. 3

In the third example it was surprising to find that steam at 16 bar and approximately 205° C. from a medium-pressure system can be exploited more profitably from the energy view-point when using it for a steam-jet ejector downstream of a turbo-compressor and not as driving steam for a turbine of an additional turbo-compressor where the heating steam pressure is increased from 2.3 to 3.8 bar. If the driving steam is used for a turbine, where it is depressurized to saturation level, only part of it is suitable for heating because the condensation water must be removed. When depressurizing the steam to 3.8 bar and approximately 142° C. i.e. if the steam is not completely saturated, the useful energy difference is only approximately 63 kJ/kg.

However, for 17,720 kg/h steam, this useful energy difference is entirely insufficient to compress 14,335 kg/h pre-compressed steam from 2.3 to 3.8 bar.

17,720 kg/h medium-pressure steam yield only 310 kW because the turbine will exhibit a more unfavorable performance than the steam-jet ejector due to the final condition of the medium-pressure steam. A turbine with low output will have a poorer overall efficiency at specific conditions than the steam ejector.

The work required for further compression of 14,335 kg/h pre-compressed steam is 450 kW.

The example shows that 17,720 kg/h steam from the medium-pressure steam system are insufficient to increase the pressure of the pre-compressed steam under the conditions governing the final state of the depressurized steam.

We claim:

1. A process for producing steam, said process comprising generating steam by evaporating water at a temperature not higher than about 115° C. and a pressure not substantially higher than the vapor pressure of water at the temperature of evaporation, mechanically compressing the steam generated to a pressure which is from 3.0 to 4.5 times that at which the water was evaporated, and further compressing the mechanically compressed steam by means of at least one steam jet ejector to a pressure of from 3.0 to 6.0 bar which is at least 1.4 times the pressure to which the steam was compressed mechanically and a temperature of from 140° to 165° C.

2. A process according to claim 1 wherein the step of evaporating water is carried out at a sub-atmospheric pressure.

3. Process according to claim 1 or 2, characterized in that the steam generated is pre-compressed by mechanical means to a pressure higher than the initial pressure by a factor of 2.0 to 3.0.

4. Process according to claim 1 or 2, characterized in that the main stream pre-compressed according to (b) is split up into several part-streams and each part-stream undergoes thermodynamic compression.

5. A process according to claim 1 wherein condensate is ejected into the mechanically compressed steam to cause a gradual reduction of the superheating thereof.

6. A process according to claim 1 wherein the water which is evaporated is a condensate from a heating operation.

7. A process according to claim 1 wherein the water which is evaporated is a heated feed water.

8. A process according to claim 1 wherein a part of the water which is evaporated is a condensate from a heating operation and a part is a heated feed water.

9. Process according to claim 1, 2 or 3, characterized in that the steam compressed by mechanical means is mixed with re-evaporated steam having an equal or a higher pressure.

10. Process according to claims 1, 2, 5, 6, 7, or 8, characterized in that the steam with pressure of 3.0 to 6.0 bar is partly desuperheated by the addition of condensate.

11. Process according to claim 3, characterized in that the steam pre-compressed by mechanical means to a pressure higher than the initial pressure by a factor of 2.0 to 3.0 is split up into several part-streams and each part-stream undergoes thermodynamic compression.

12. Process according to claim 3, characterized in that the steam compressed by mechanical means is mixed with re-evaporated steam having an equal or a higher pressure.

13. Process according to claim 3, characterized in that the steam with pressure of 3.0 to 6.0 bar is partly desuperheated by the addition of condensate.

14. Process according to claim 4, characterized in that the steam with pressure of 3.0 to 6.0 bar is partly desuperheated by the addition of condensate.

15. Process according to claim 9, characterized in that the steam with pressure of 3.0 to 6.0 bar is partly desuperheated by the addition of condensate.

16. Process according to claim 11, characterized in that the steam with pressure of 3.0 to 6.0 bar is partly desuperheated by the addition of condensate.

17. Process according to claim 12, characterized in that the steam with pressure of 3.0 to 6.0 bar is partly desuperheated by the addition of condensate.

18. Process according to claim 10 characterized in that the steam is generated by evaporating a plurality of bodies of heat-transfer liquid at a plurality of low temperatures and pressures, and the pre-compressing by mechanical means is to a pressure higher than each of the initial pressures by a factor of 2.0 to 3.5.

19. Process according to claims 1, 2, 5, 6, 7 or 8 characterized in that steam is generated according to (a) by evaporating a plurality of bodies of heat-transfer liquid at a plurality of low temperatures and pressures, and the pre-compressing by mechanical means is to a pressure higher than each of the initial pressures by a factor of 2.0 to 3.5.

* * * * *